US008113607B2

(12) United States Patent
Slager et al.

(10) Patent No.: US 8,113,607 B2
(45) Date of Patent: Feb. 14, 2012

(54) STORAGE ASSEMBLY

(75) Inventors: Mark T. Slager, Caledonia, MI (US); Timothy S. DeVries, Hudsonville, MI (US)

(73) Assignee: Steelcase Inc., Grand Rapids, MI (US)

( * ) Notice: Subject to any disclaimer, the term of this patent is extended or adjusted under 35 U.S.C. 154(b) by 412 days.

(21) Appl. No.: 12/437,882

(22) Filed: May 8, 2009

(65) Prior Publication Data

US 2010/0281931 A1 Nov. 11, 2010

(51) Int. Cl.
*A47B 95/00* (2006.01)

(52) U.S. Cl. ..... 312/304; 312/350; 312/218; 49/128; 49/209; 70/95; 70/99; 70/100; 292/137; 292/143; 292/340

(58) Field of Classification Search ..... 49/103, 49/128, 129, 130, 209; 292/143, 340, 340.15, 292/137, 138, 139; 70/90, 95–100; 312/295, 312/216, 217, 218, 219, 220, 304
See application file for complete search history.

(56) References Cited

U.S. PATENT DOCUMENTS

| | | | | |
|---|---|---|---|---|
| 0,834,673 | A | 10/1906 | Hussey et al. | |
| 0,880,350 | A | 2/1908 | Balch | |
| 1,004,299 | A | 9/1911 | Outland | |
| 1,403,178 | A * | 1/1922 | John | 292/138 |
| 1,438,547 | A * | 12/1922 | O'Connor | 292/161 |
| 1,490,321 | A * | 4/1924 | Hochreiner | 292/33 |
| 1,636,806 | A | 7/1927 | Campbell | |
| 2,142,469 | A * | 1/1939 | Williamson et al. | 312/295 |
| 2,317,312 | A | 4/1943 | Swanson et al. | |
| 2,819,498 | A | 1/1958 | Grossman | |
| 2,846,733 | A * | 8/1958 | Barsotti | 49/178 |
| 2,860,387 | A | 11/1958 | Grossman | |
| 2,899,252 | A * | 8/1959 | Rolfe | 312/139.2 |
| 2,944,282 | A * | 7/1960 | Greco | 16/87 R |
| 2,992,460 | A | 7/1961 | Hentges | |
| 3,017,674 | A | 1/1962 | Brill | |
| 3,122,795 | A | 3/1964 | Harle | |
| 3,293,801 | A | 12/1966 | Henning | |
| 3,334,375 | A * | 8/1967 | Eugene | 16/97 |
| 3,510,983 | A | 5/1970 | Barabas | |
| 3,660,936 | A * | 5/1972 | Bryson | 49/209 |

(Continued)

FOREIGN PATENT DOCUMENTS

| | | |
|---|---|---|
| JP | 7247669 | 9/1995 |

(Continued)

*Primary Examiner* — Darnell Jayne
*Assistant Examiner* — Kimberley S Wright
(74) *Attorney, Agent, or Firm* — Price Heneveld LLP

(57) ABSTRACT

A storage assembly comprises a storage unit having a plurality of walls that cooperate to form an interior space and an opening in communication with the interior space, a first track having a first width and a second width along the length thereof, and a second track having a first width and a second width along the length thereof, wherein the second widths are different than the first widths, respectively. The storage assembly comprises a first door assembly slidably disposed along the first and second tracks via first guide members each having width less than the first width of the first and second tracks, and a second door assembly slidably disposed along the first and second tracks, and having a pair of second guide members each having a width that is greater than the first width of the first and second tracks and less than the second width of the first and second tracks.

16 Claims, 9 Drawing Sheets

U.S. PATENT DOCUMENTS

| | | | | | |
|---|---|---|---|---|---|
| 4,048,755 | A | | 9/1977 | Wolak et al. | |
| 4,064,810 | A | | 12/1977 | Jenkins et al. | |
| 4,240,226 | A | * | 12/1980 | Georgelin | 49/223 |
| 4,384,429 | A | | 5/1983 | Rokicki et al. | |
| 4,438,595 | A | | 3/1984 | MacDonald | |
| 4,445,729 | A | * | 5/1984 | Scheerhorn | 312/219 |
| 4,452,011 | A | | 6/1984 | Trombettas | |
| 4,486,040 | A | * | 12/1984 | Strangward | 292/160 |
| 4,551,945 | A | | 11/1985 | von Resch | |
| 4,562,667 | A | | 1/1986 | von Resch | |
| 4,565,031 | A | | 1/1986 | Sakamoto | |
| 4,570,381 | A | | 2/1986 | Sterner, Jr. | |
| 4,574,524 | A | | 3/1986 | Bonetti et al. | |
| 4,601,499 | A | * | 7/1986 | Kim | 292/36 |
| 4,608,777 | A | * | 9/1986 | Okamoto | 49/214 |
| 4,624,073 | A | | 11/1986 | Randall | |
| 4,642,947 | A | | 2/1987 | Dickson | |
| 4,644,690 | A | | 2/1987 | Caimi | |
| 4,656,781 | A | | 4/1987 | Niekrasz et al. | |
| 4,662,108 | A | * | 5/1987 | Romero et al. | 49/130 |
| 4,669,219 | A | * | 6/1987 | Tomida | 49/130 |
| 4,697,384 | A | * | 10/1987 | Tutikawa | 49/130 |
| 4,728,162 | A | | 3/1988 | Bruneau | |
| 4,752,106 | A | | 6/1988 | Salvarani | |
| 4,924,930 | A | | 5/1990 | Drennan | |
| 4,928,450 | A | | 5/1990 | Rutledge | |
| 4,934,098 | A | * | 6/1990 | Prouteau et al. | 49/214 |
| 4,949,504 | A | | 8/1990 | Bortoluzzi | |
| 5,005,315 | A | | 4/1991 | Jackson, Jr. | |
| 5,120,094 | A | * | 6/1992 | Eaton et al. | 292/159 |
| 5,189,837 | A | | 3/1993 | Ienaga | |
| 5,287,653 | A | | 2/1994 | Young | |
| 5,481,840 | A | * | 1/1996 | Dickson | 52/241 |
| 5,542,214 | A | * | 8/1996 | Buening | 49/380 |
| 5,595,076 | A | * | 1/1997 | Weinerman et al. | 70/208 |
| 5,613,323 | A | | 3/1997 | Buening | |
| 5,630,294 | A | | 5/1997 | Bruno | |
| 5,632,119 | A | | 5/1997 | Bruno | |
| 5,724,771 | A | * | 3/1998 | Gipson | 49/449 |
| 5,799,444 | A | * | 9/1998 | Freimark et al. | 49/413 |
| 5,799,449 | A | * | 9/1998 | Lyons et al. | 52/204.51 |
| 5,970,662 | A | | 10/1999 | Corcorran et al. | |
| 5,996,282 | A | | 12/1999 | Giovannetti | |
| 5,996,284 | A | * | 12/1999 | Freimark et al. | 49/209 |
| 5,996,285 | A | * | 12/1999 | Guillemet et al. | 49/213 |
| 6,076,308 | A | | 6/2000 | Lyon et al. | |
| 6,336,246 | B1 | | 1/2002 | Giovannetti | |
| 6,415,553 | B1 | | 7/2002 | Krayer, Jr. et al. | |
| 6,454,320 | B1 | * | 9/2002 | Weinerman et al. | 292/56 |
| 6,460,293 | B1 | | 10/2002 | Bischof | |
| 6,497,072 | B2 | | 12/2002 | Fries | |
| 6,691,462 | B2 | | 2/2004 | Oestermann | |
| 6,826,867 | B1 | | 12/2004 | McDonald et al. | |
| 6,860,064 | B2 | | 3/2005 | Bakalar | |
| 6,899,362 | B1 | * | 5/2005 | Weinerman et al. | 292/336.3 |
| 7,003,916 | B2 | * | 2/2006 | Nestell et al. | 49/413 |
| 7,155,863 | B2 | | 1/2007 | Daniel et al. | |
| 7,219,470 | B2 | * | 5/2007 | Lahnala | 49/413 |
| 7,673,419 | B2 | * | 3/2010 | Arimoto | 49/380 |
| 7,735,897 | B2 | * | 6/2010 | Seiple et al. | 296/84.1 |
| 7,934,342 | B2 | * | 5/2011 | Lahnala | 49/380 |
| 7,963,070 | B2 | * | 6/2011 | Recker | 49/380 |
| 2003/0150165 | A1 | | 8/2003 | Ronay et al. | |
| 2005/0044798 | A1 | * | 3/2005 | Daniel et al. | 49/413 |
| 2006/0071484 | A1 | * | 4/2006 | Chen | 292/336.3 |
| 2006/0225357 | A1 | | 10/2006 | Bortoluzzi | |
| 2008/0078216 | A1 | * | 4/2008 | Fleming | 70/113 |

FOREIGN PATENT DOCUMENTS

| | | |
|---|---|---|
| KR | 20-0370195 | 12/2004 |
| WO | 2006/003005 | 1/2006 |
| WO | 2007/062472 | 6/2007 |

* cited by examiner

STORAGE ASSEMBLY

BACKGROUND OF THE INVENTION

The present invention relates to a storage assembly, and in particular to a storage assembly comprising a track arrangement allowing a compact, flush positioning of a plurality of doors of the storage assembly when the doors are in a closed position.

SUMMARY OF THE INVENTION

A storage assembly comprises a storage unit including top wall, a bottom wall and a pair of sidewalls that cooperate to form an interior space in an opening and communication with the interior space. The storage assembly also comprises a first track and a second track, the first track disposed across a bottom of the opening of the storage unit and including a first portion having a first width and a second portion having a second width that is different than the first width, wherein the first portion is at least partially vertically offset and at least partially offset along a length of the first portion from the second portion, the second track disposed across the bottom of the opening of the storage unit and including a first portion having a first width and a second portion having a second width that is different than the first width of the first portion of the second track, wherein the first portion of the second track is at least partially vertically offset and at least partially offset along the length of the first portion of the second track from the second portion of the second track. The storage assembly further comprises a first door assembly slidably disposed within the opening between a first position and a second position that is at least partially laterally offset from the first position, the first door including a pair of first guide members each having a width that is less than the first width of the first portion of the first track and less than the first width of the first portion of the second track respectively, wherein the pair of first guide members guide within the first portion of the first track and the first portion of the second track, respectively. The storage assembly further includes a second door assembly slidably disposed within the opening between a first position and a second position that is at least partially laterally offset from the first position of the second door assembly, the second door including a pair of first guide members each having a width that is greater than the first width of the first portion of the first track and less than the second width of the second portion of the second track, and greater than the first width of the first portion of the first track and less than the second width of the second portion of the second track, respectively, wherein the pair of first guide members of the second door assembly guide within the second portion of the first track and the second portion of the second track, respectively, and wherein the first and second door assemblies are substantially co-planar when in the first positions thereof.

Another aspect of the present invention is a door track assembly adapted to slidably support a pair of doors within a storage assembly, the door track assembly comprising a first track positionable across a select one of a bottom wall and a top wall of the storage assembly, the first track including a first portion having a first width adapted to slidably receive a first door guide member therein, and a second portion having a second width that is different than the first width and that is adapted to slidably receive a second door guide member therein, wherein the first portion is at least partially vertically offset and at least partially offset along a length of the first portion from the second portion. The door track assembly further comprises a second track positionable across the select one of the bottom wall and a top wall of a storage assembly, the second track including a first portion having a first width adapted to slidably receive a third door guide member therein, and a second portion having a second width that is different than the first width of the second track and that it is adapted to slidably receive a fourth door guide member therein, wherein the first portion of the second track is at least partially vertically offset and at least partially offset along the length of the first portion from the second portion of the second track.

Yet another aspect of the present invention is to provide a storage assembly that comprises a storage unit including a top wall, a bottom wall and a pair of sidewalls that cooperate to form an interior space and an opening in communication with the interior space, a first track disposed across the bottom wall of the storage unit and having at least one longitudinally-extending channel, a second track disposed across the bottom wall of the storage unit and having at least one longitudinally-extending channel, a first door slidably supported within the first and second tracks by at least one first guide member, and a second door slidably supported within the first and second tracks by at least one second guide member. The storage assembly further comprises a lock assembly including a lock member having a plurality of reliefs and movable between an unlocked position, wherein the plurality of reliefs are aligned with the channels of the first and second tracks, thereby allowing the at least one first guide member and the at least one second guide member to pass by the lock member and move along the length of the first and second tracks, and a locked position, wherein the plurality of reliefs are not aligned with the channels of the first and second tracks, thereby preventing the at least one first guide member and the at least one second guide member to pass by the lock member and move along the length of the first and second tracks.

The present invention provides a storage assembly having an uncomplicated design that can be easily and quickly assembled and operated by even unskilled personnel. The present inventive storage assembly is economical to manufacture, capable of a long-operating life, provides a pleasing aesthetic appearance, and is particularly well adapted for the proposed use.

These and other advantages of the invention will be understood and appreciated by those skilled in the art by reference to the following written specification, claims and appended drawings.

DETAILED DESCRIPTION OF THE PREFERRED EMBODIMENTS

Figure 1:
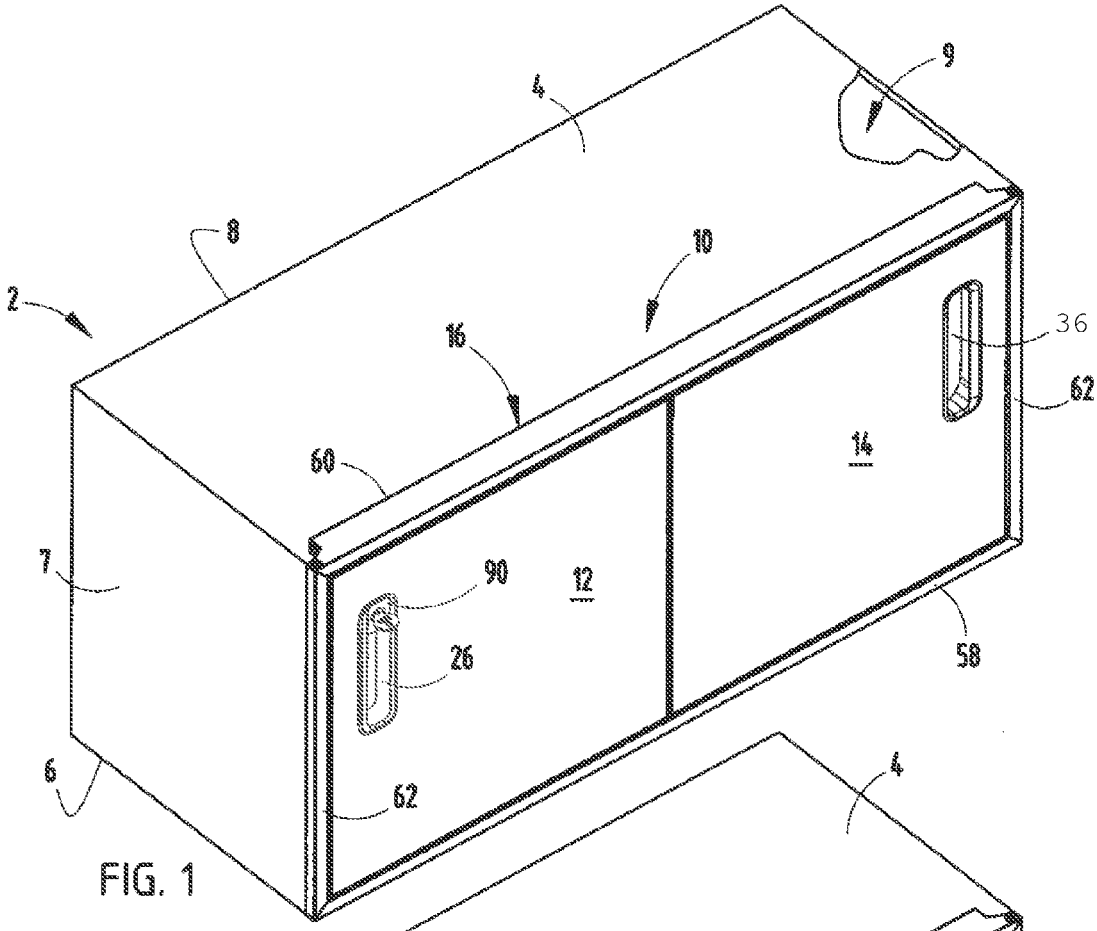
FIG. 1 is a perspective view of a top, front and first end of a storage assembly, wherein a pair of doors are in a closed position.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings, and described in the following specification are exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
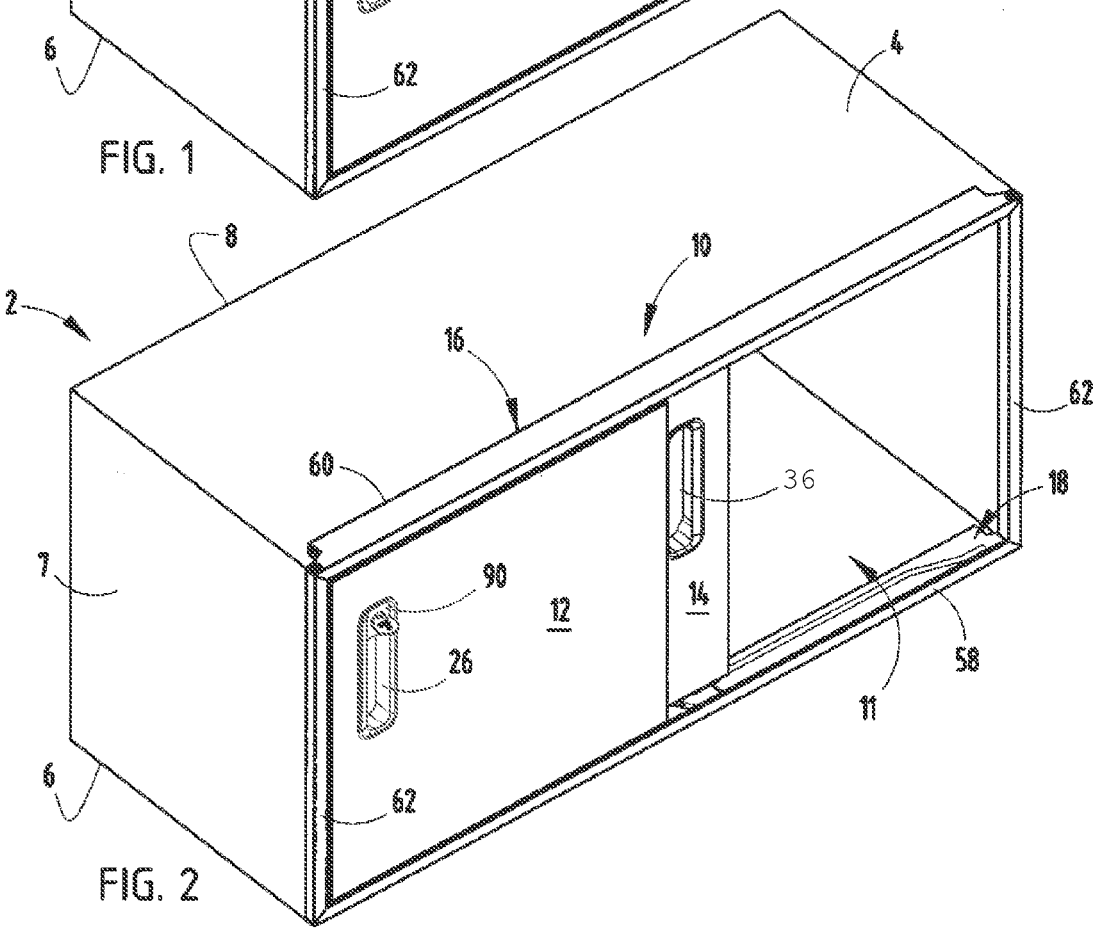
FIG. 2 is a perspective view of the storage assembly, wherein one of the doors is in an open position.
Figure 3:
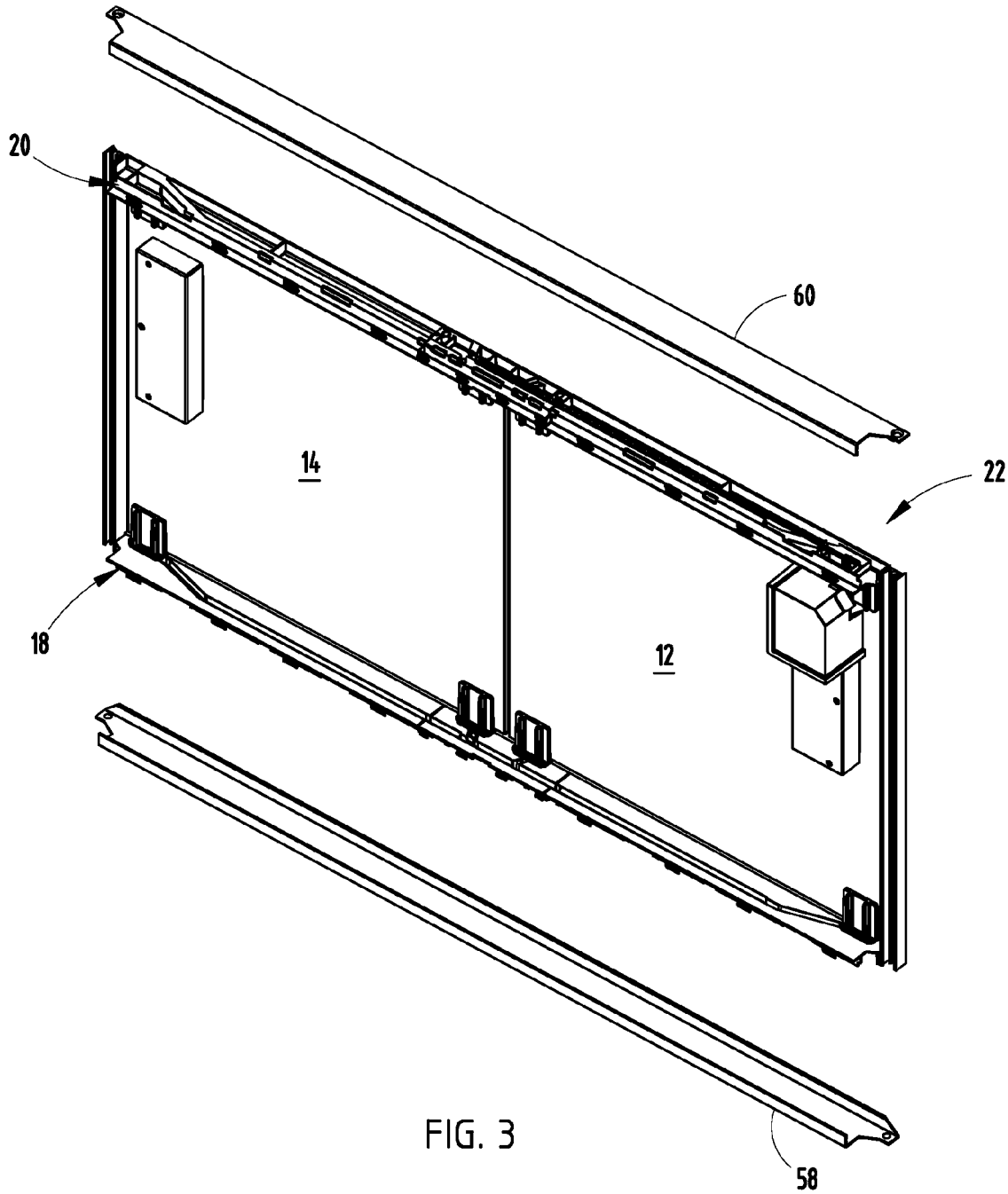
FIG. 3 is an exploded perspective view of a front wall assembly.

The reference numeral 2 (FIG. 1) generally designates a storage assembly embodying the present invention. In the illustrated example, the storage assembly 2 includes a top wall 4, a bottom wall 6, a pair sidewalls 7, and a rear wall 8 that cooperate with one another to define an interior space 9 and an opening 11 (FIG. 2) in communication with the interior space 9. A front wall assembly 10 includes a first door assembly 12 and a second door assembly 14 slidably disposed within a frame assembly 16 between a closed position (FIG. 1), and an open position (FIG. 2), a lower track assembly 18 (FIG. 3), an upper track assembly 20, and a lock assembly 22.

Figure 4:
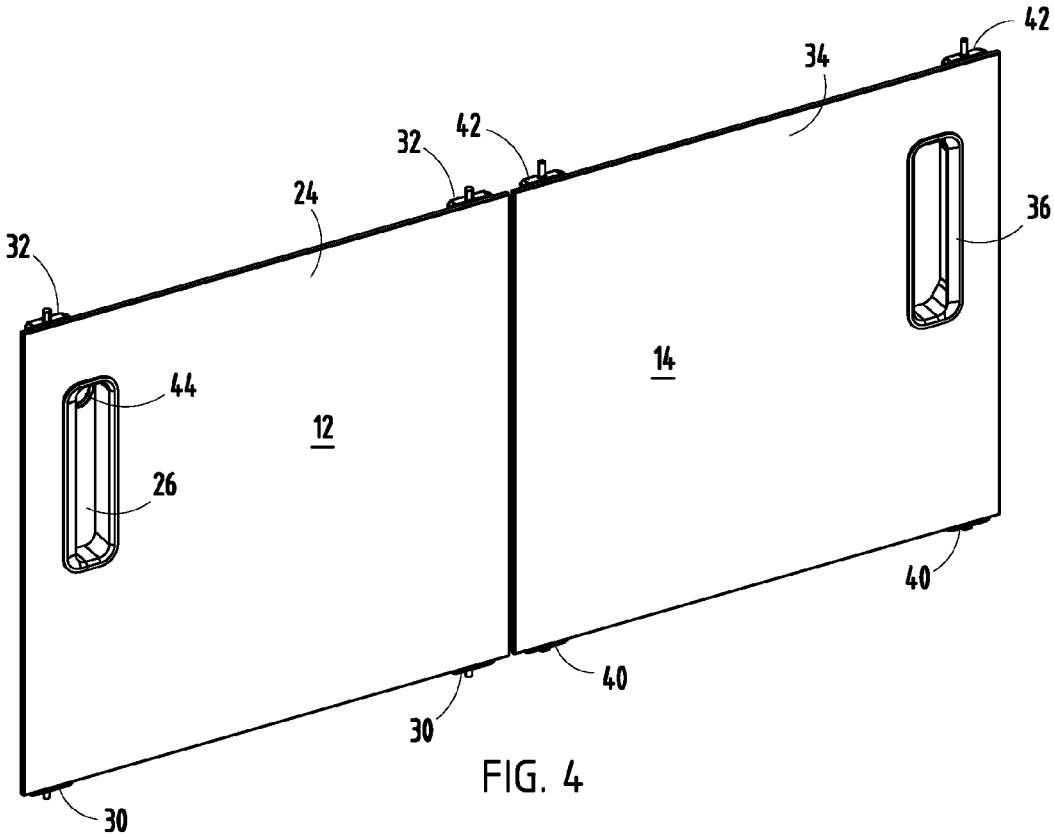
FIG. 4 is a front perspective view of the pair of doors.
Figure 5:
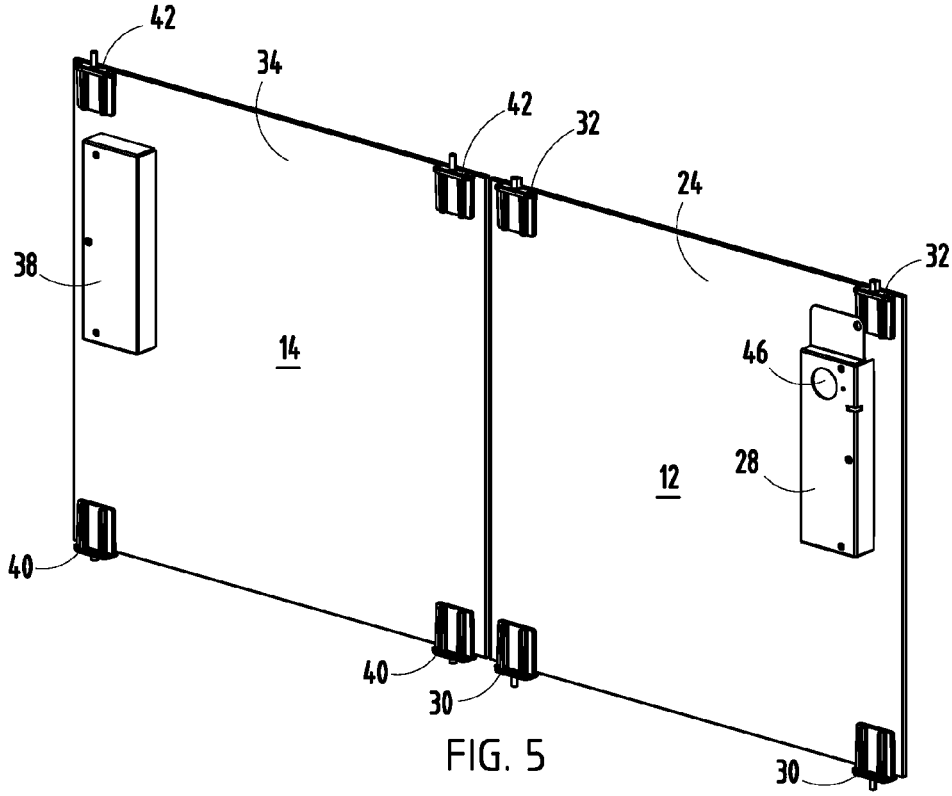
FIG. 5 is a rear perspective view of the pair of doors.
Figure 6:
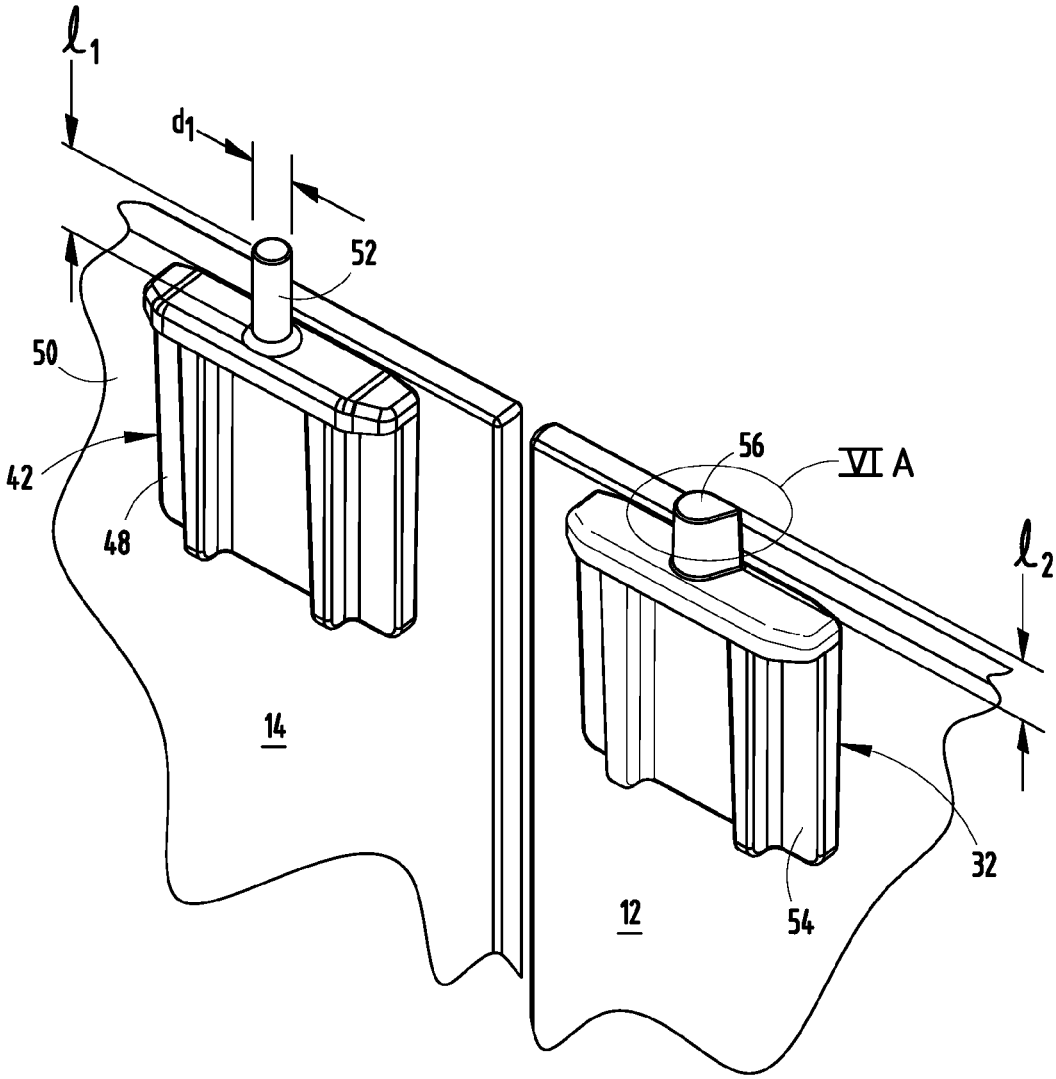
FIG. 6 is an enlarged perspective view of a pair of guide members.

The first door assembly 12 (FIGS. 4 and 5) includes a planar door member 24, a door handle 26 positioned within the door member 24, a door handle housing 28, a pair of downwardly-extending guide members 30 and a pair of upwardly-extending guide members 32. The second door assembly 14 includes a planar door member 34, a door handle 36 located within the door member 34, a door handle housing 38, a pair of downwardly-extending guide members 40 and a pair of upwardly-extending guide members 42. The door handle 26 and the door handle housing 28 of the first door assembly 12 each include an aperture 44, 46 that receives a portion of the lock assembly 22 therethrough, as described below. As best illustrated in FIG. 6, each of the downwardly-extending guide members 30 and upwardly-extending guide members 42 include an L-shaped mounting portion 48 secured to a rear surface 50 of the associated door member 24, 34, and a guide pin 52 having a diameter $d_1$ and a length $l_1$. As also illustrated in FIG. 6, each of the upwardly-extending guide members 32 and downwardly-extending guide members 40 include a mounting portion 54 secured to a rear surface 50 of the associated door member 24, 34, and a guide pin 56 having a diameter $d_2$ and a length $l_2$ and.

The frame assembly 16 includes a c-shaped bottom frame member 58, a c-shaped top frame member 60 and a pair of side frame members 62 that cooperate to surround the opening 11. The bottom frame member 58 is configured to house the lower track assembly 18, while the top frame member 60 is configured to house the upper track assembly 20 as well as portions of the lock assembly 22 therein, as described below.

Figure 7:
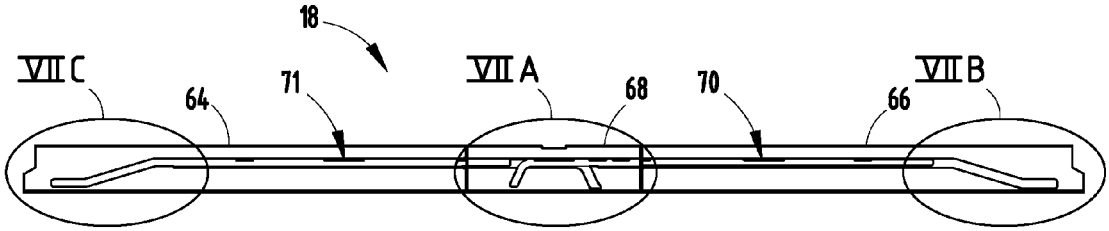
FIG. 7 is a top plan view of a lower track assembly.
Figure 7A:
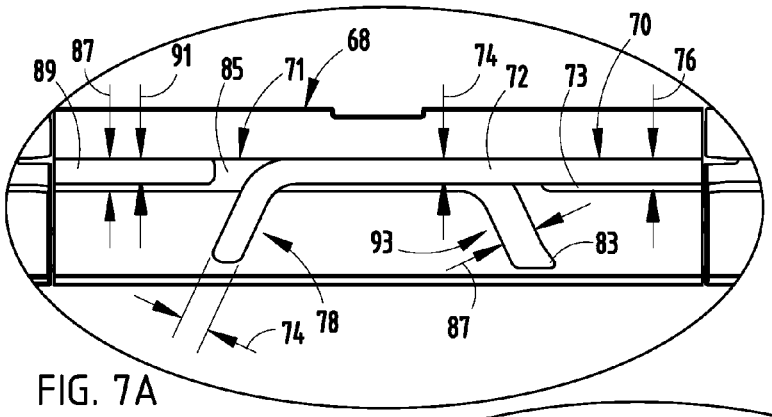
FIG. 7A is an enlarged top plan view of area 7*a*, FIG. 7.
Figure 7B:
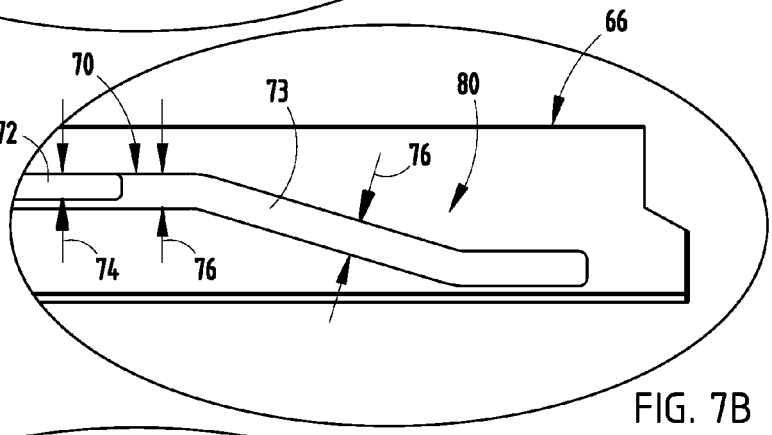
FIG. 7B is an enlarged plan view of area 7*b*, FIG. 7.
Figure 7C:
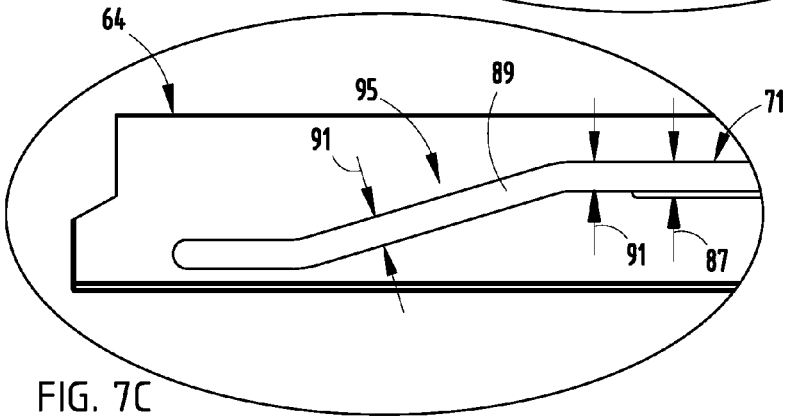
FIG. 7C is an enlarged plan view of area 7*c*, FIG. 7.

The lower track assembly 18 (FIGS. 7-7C) comprises three separate pieces including a first end piece 64, a second end piece 66 and a central piece 68 located between the first end piece 64 and the second end piece 66 and coupled thereto. As the upper track assembly 20 is a rotation of the lower track assembly 18, description of only the lower track 18 is provided herein. The lower track assembly 18 includes a pair of channels extending therealong including a first channel 70 and a second channel 71. The first channel 70 includes a first portion 72 having a first width 74 and a second portion 73 with a second width 76. The first portion 72 of the first channel 70 includes a forwardly-extending end portion 78 having the first width 74, while the second portion includes a forwardly-extending end portion 80 having the second width 76.

The second channel 71 includes a first portion 85 having a first width 87 that is the same as the second width 76, and a second portion 89 with a second width 91 that is the same as the first width 87. The second portion 89 of the second channel 71 includes a forwardly-extending end portion 93 having the first width 87, while the second portion 89 includes a forwardly-extending end portion 95 having the second width 91.

Figure 6A:
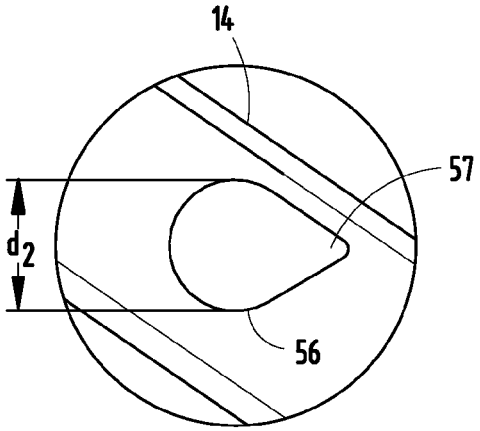
FIG. 6A is a top plan view of area 6*a*, FIG. 6.

The first width 74 and second width 91 are each sized with respect to width and depth to slidably guide the diameter $d_1$ and length $l_1$ of the guide members 30 and 42 therealong, respectively, while the width and depth of the second width 76 and first width 87 are sized so as to slidably guide the diameter $d_2$ and length $l_2$ of the guide members 32 and 40 therealong, respectively. It is noted that the diameter $d_2$ of each of the guide pins 56 is larger than the first width 74 and the second width 91, thereby preventing guide pins 56 from entering any section a channel having the second width 74 or first width 91. As best illustrated in FIG. 6A, at least one of the guide pins 56 is provided with a tear-drop-shape defining a narrowed or tapered end 57 that is received within a correspondingly-shaped notch 83 located within an end of a corresponding track, thereby biasing the associated door into flush position when in the closed position.

In operation, the first door assembly 12 and the second door assembly 14 are positioned such that they are planar with one another with the relative guide pins 52 and 56 being located within the associated end portions 78, 80, 93, 95 of the first and second channels 70, 71. Each door assembly 12, 14 may be opened and positioned rearwardly of the other door by forcing the door being opened rearwardly such that the associated pins 52, 56 guide within the associated channels.

Figure 8:
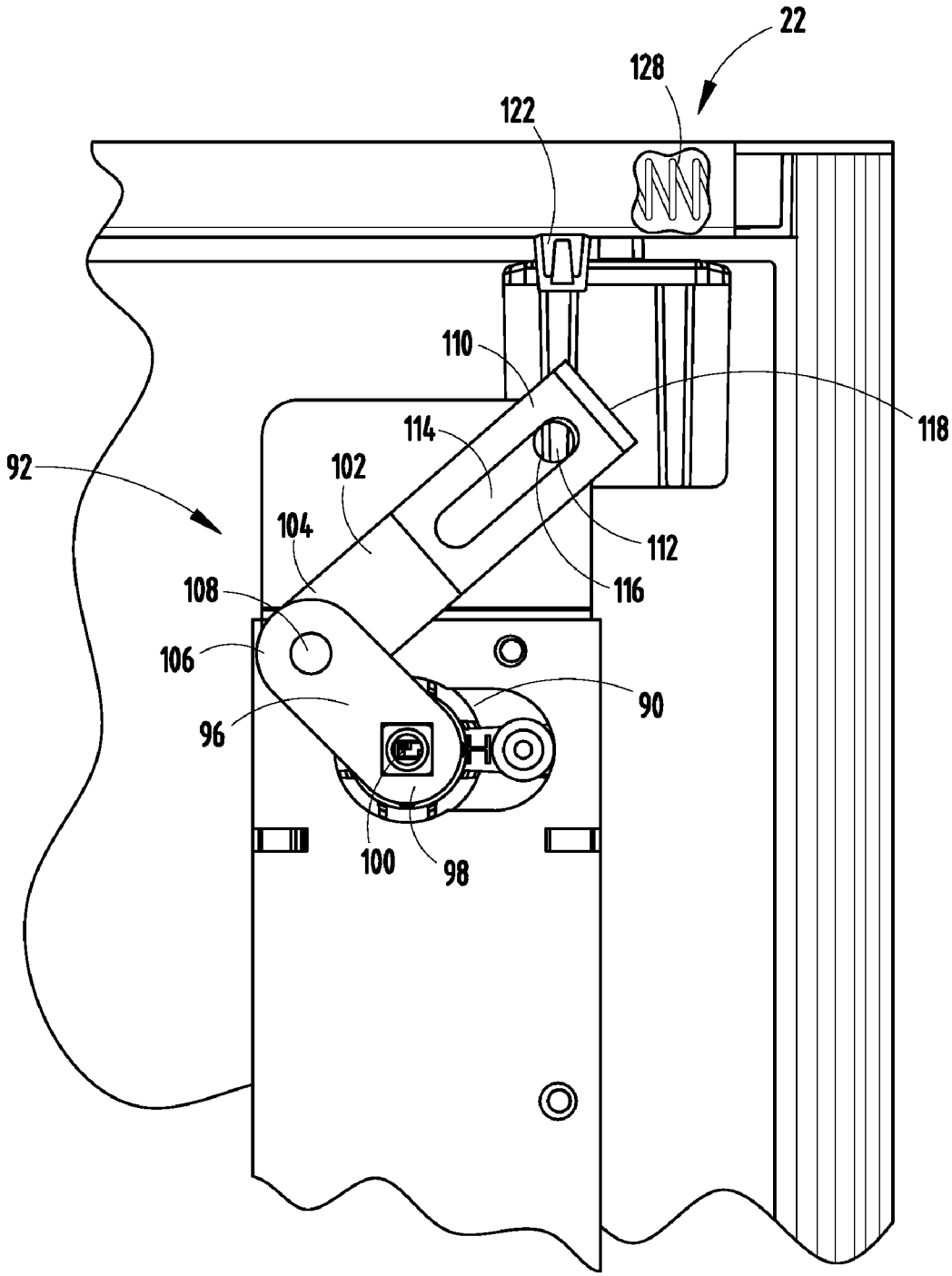
FIG. 8 is a rear elevational view of a lock assembly.
Figure 9A:
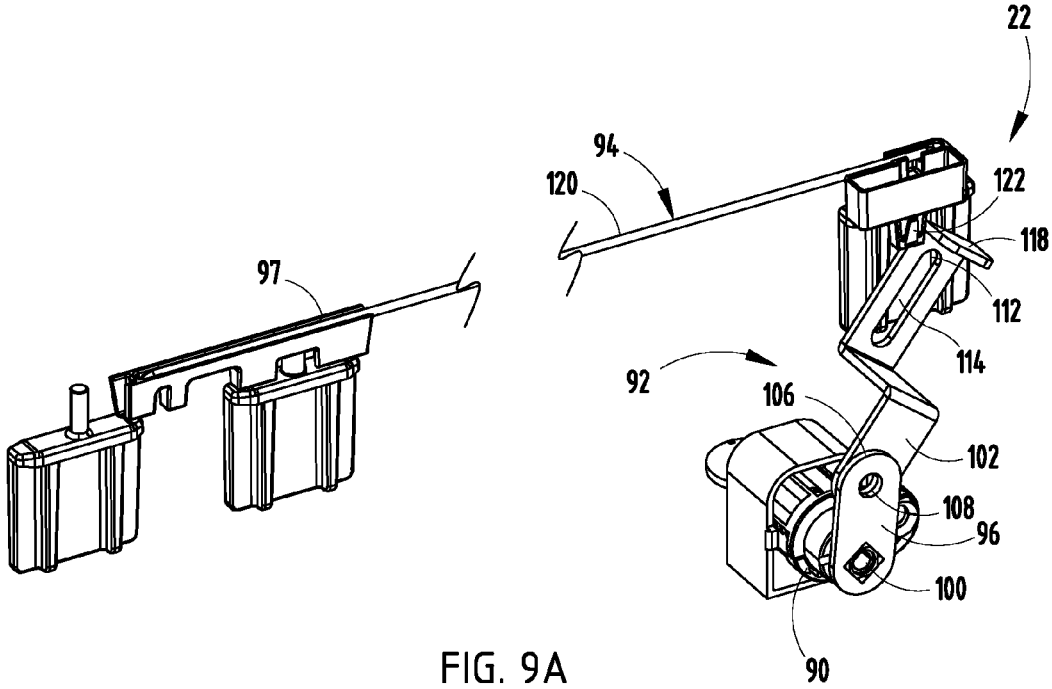
FIG. 9A is a perspective view of the lock assembly in an unlocked position.
Figure 9B:
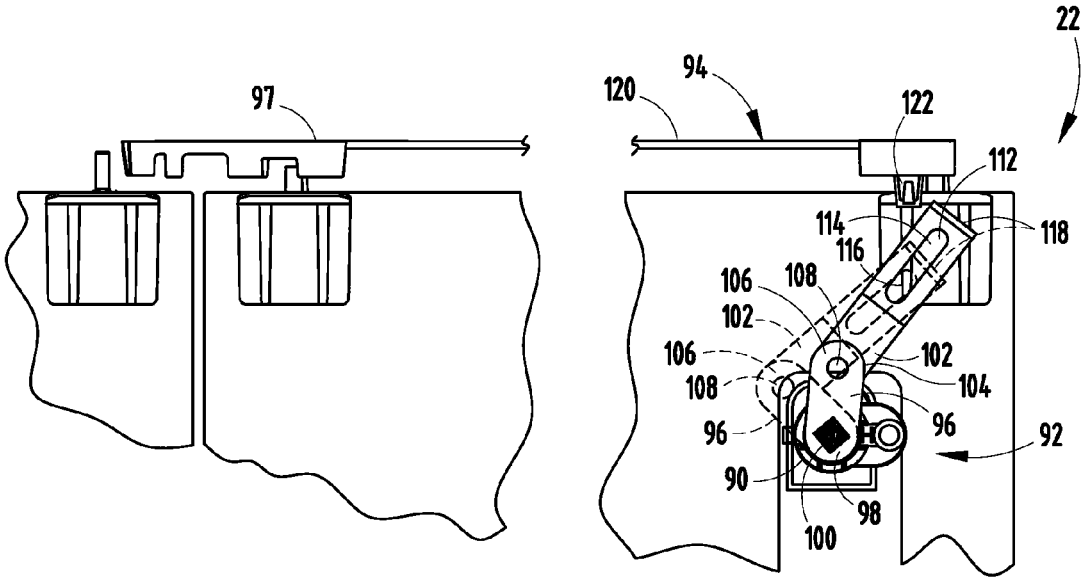
FIG. 9B is a rear elevational view of the lock assembly in an unlocked position.
Figure 9C:
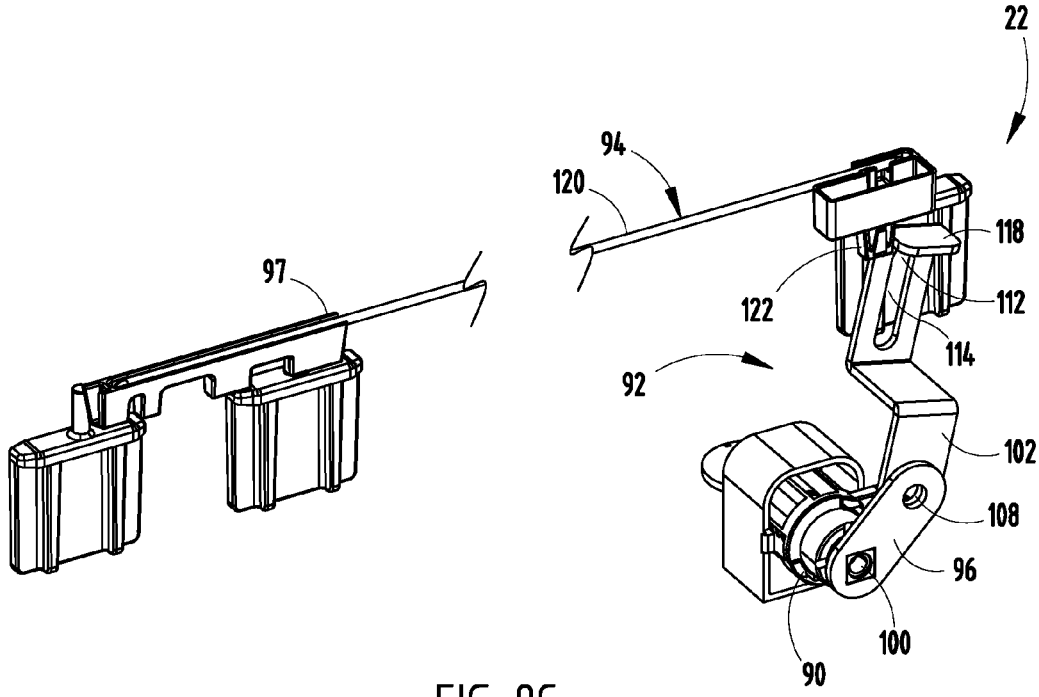
FIG. 9C is a perspective view of the lock assembly in a locked position.
Figure 9D:
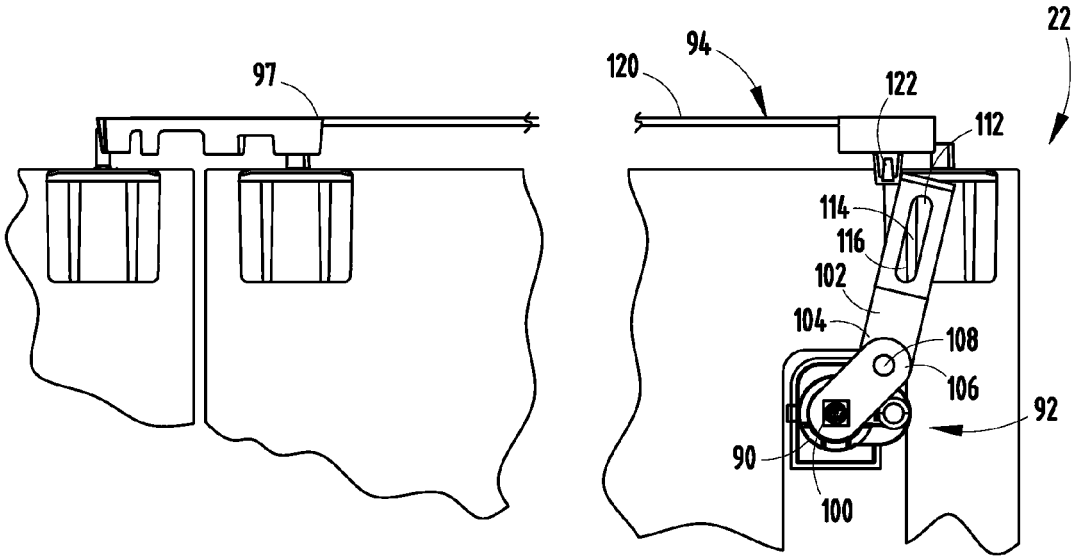
FIG. 9D is a rear elevational view of the lock assembly in a locked position.
Figure 10:
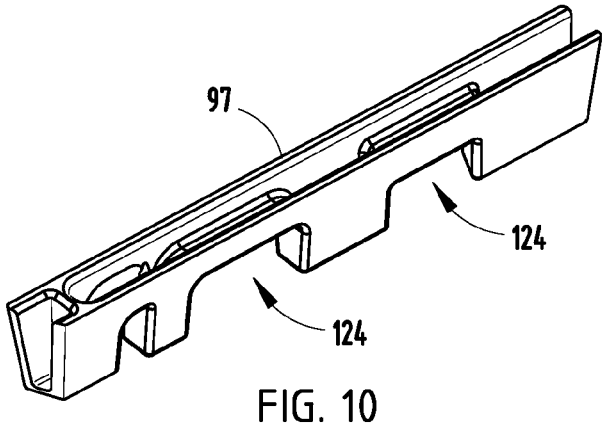
FIG. 10 is a perspective view of a locking member of the locking assembly.
Figure 11B:
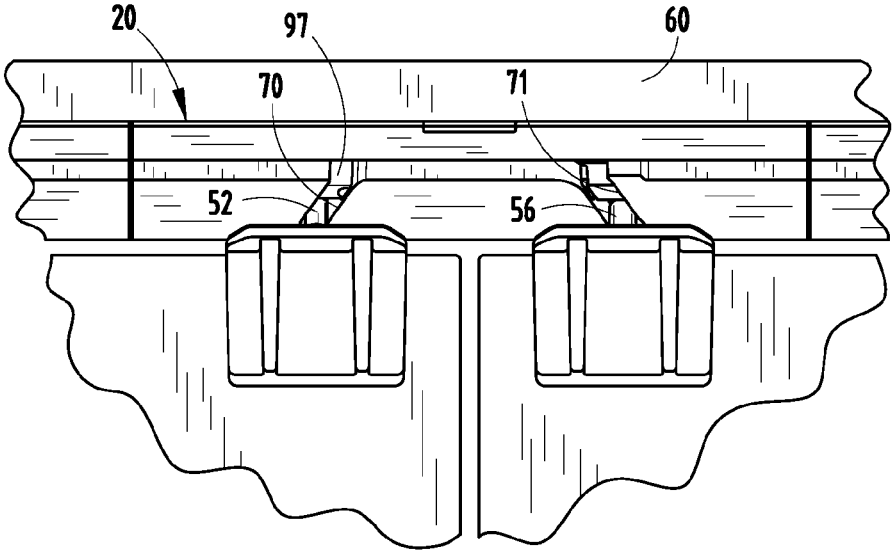
FIG. 11B is perspective view of the locking member in a locked position.
Figure 11A:
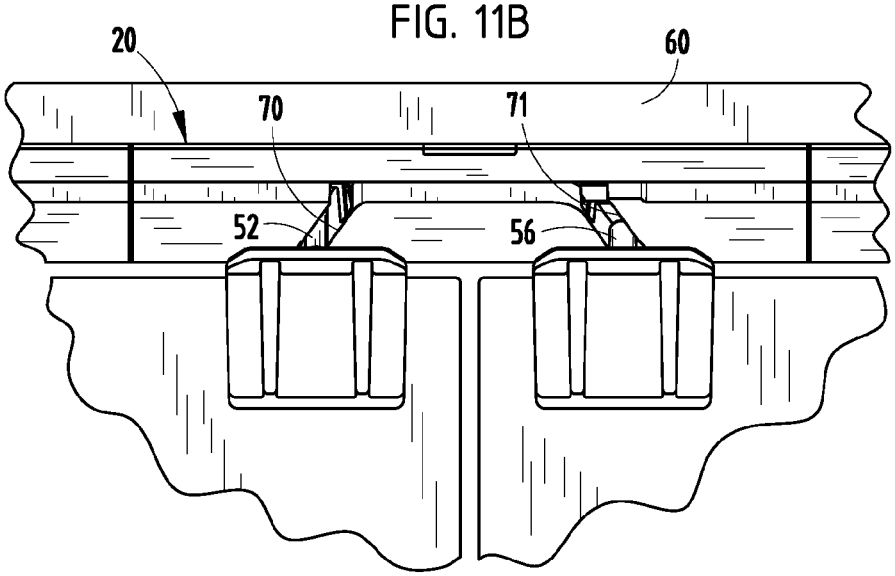
FIG. 11A is a perspective view of the locking member in an unlocked position.

The lock assembly 22 (FIG. 8) includes a keyed lock tumbler 90 and a lock strike assembly 92 operably engageable with a lock rod assembly 94 (FIG. 9A) and a locking member 97. The lock strike assembly 92 includes a two-bar linkage assembly including a first member 96 having a first end 98 coupled for rotation with the lock tumbler 90 about a pivot point 100, and a second member 102 having a first end 104 pivotally coupled to a second end 106 of the first member 96 for rotation about a pivot point 108. A second end 110 of the second member 102 is slidably and pivotally coupled with respect to the first door assembly 12 about a pivot point 112. Second member 102 includes a longitudinally-extending slot 114 that slidably and pivotally receives a pivot pin 116 defining the pivot point 112. The second end 110 of the second member 102 further includes an orthogonally-extending striker element 118. The lock rod assembly 94 includes a lock rod 120 extending between a catch 122 and the lock member 97. The lock rod assembly 94 is slidably positioned within the upper track assembly 20, such that the lock member 97 is movable between a locked position and an unlocked position as described below. The lock member 97 (FIG. 10) includes a plurality of reliefs extending therethrough that allow passage of the guide pins 52, 56 along the channels 70, 71 of the upper track assembly 20 depending on the position of the lock member 97 within the upper track assembly 20. Specifically, as best illustrated in FIGS. 9A-9D, 11A and 11B, the lock tumbler 90 is used to actuate the lock strike assembly 92, which in turn is used to move the lock rod assembly 94 within the upper track assembly 20. When moved to the unlocked position, the locking member 97 is positioned such that the reliefs 124 of the lock member 97 are aligned with the channels 70, 71, thereby allowing the pins 52, 56 to travel therealong and either of the door assemblies 12, 14 to be moved from the closed to the opened position. When in the locked position, the lock member 97 is positioned with respect to the upper track assembly 20 such that the lock member 97 is located within the first channel 70 and the second channel 71, thereby preventing the pins 52, 56 from traveling along the channels 70, 71, and preventing the door assemblies 12, 14 from being moved from the closed to the open positions. A spring 128 biases the lock rod assembly 94 into an unlocked position.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. A storage assembly, comprising:

a storage unit including a top wall, a bottom wall and a pair of sidewalls that cooperate to form an interior space and an opening in communication with the interior space;

a first track disposed across a bottom of the opening of the storage unit, and including a first portion having a first width and a second portion having a second width that is different than the first width, wherein the first portion is at least partially vertically offset and at least partially offset along a length of the first portion from the second portion;

a second track disposed across a bottom of the opening wall of the storage unit, and including a first portion having a first width and a second portion having a second width that is different than the first width of the first portion of the second track, wherein the first portion of the second track is at least partially vertically offset and at least partially offset along a length of the first portion of the second track from the second portion of the second track;

a first door assembly slidably disposed within the opening between a first position and a second position that is at least partially laterally offset from the first position, the first door assembly including a pair of first guide members each having a width that is less than the first width of the first portion of the first track and less than second width of the second portion of the second track, respectively, wherein the pair of first guide members guide within the first portion of the first track and the first portion of the second track, respectively; and a second door assembly slidably disposed within the opening between a first position and a second position that is at least partially laterally offset from the first position of the second door assembly, the second door including a pair of first guide members each having a width that is greater than the first width of the first portion of the first track and less than the second width of the second portion of the first track, and greater than the second width of the second portion of the first track and less than first width of the first portion of the second track, respectively, wherein the pair of first guide members of the second door assembly guide within the second portion of the first track and the second portion of the second track, respectively, and wherein the first and second door assemblies are substantially coplanar when in the first positions thereof.

2. The storage assembly of claim 1, wherein at least part of the first portion of the first track that is offset along the length thereof from the second portion of the first track is arcuately-shaped.

3. The storage assembly of claim 2, wherein at least part of the first portion of the second track that is offset along the length thereof from the second portion of the first track is arcuately-shaped.

4. The storage assembly of claim 1, wherein the first track and the second track are formed within a first track assembly, and wherein the first track assembly is divided into a plurality of separate segments along the length thereof.

5. The storage assembly of claim 1, further including:

a third track disposed across a top of the opening of the storage unit, the third track including a first portion having a first width and a second portion having a second width that is different than the first width, wherein the first portion is at least partially vertically offset and at least partially offset along a length of the first portion from the second portion;

a fourth track disposed across a top of the opening of the storage unit, the fourth track including a first portion having a first width and a second portion having a second width that is different than the first width of the first portion of the third track, wherein the first portion of the fourth track is at least partially vertically offset and at least partially offset along a length of the first portion of the fourth track from the second portion of the fourth track; and wherein the first door assembly includes a pair of second guide members each having a diameter that is less than the second width of the second portion of the third track and greater than the second width of the second portion of the fourth track, and wherein the second door assembly includes a pair of second guide members each having a diameter that is less than the first width of the first portion of the fourth track and less than the second portion of the third track.

6. The storage assembly of claim 5, wherein the first track and the second track are formed within a first track assembly, the first track assembly being divided into a plurality of separate segments along the length thereof, and wherein the third track and the fourth track are formed within a second track assembly, and wherein the second track assembly is divided into a plurality of separate segments along the length thereof.

7. The storage assembly of claim 5, wherein the first and second guide members of the first door assembly and the first and second guide members of the second door assembly comprise guide pins.

8. The storage assembly of claim 1, wherein at least one of the first guide members comprises substantially tear-drop-shaped pins, defining a narrowed end, and wherein an end of the select track receiving the tear-drop-shaped pin includes a notch to receive the narrowed end thereof.

9. A door track assembly adapted to slidably support a pair of doors within a storage assembly, the door track assembly comprising:

a first track positionable across a select one of a bottom wall and a top wall of a storage assembly, the first track including a first portion having a first width adapted to slidably receive a first door guide member therein, and a second portion having a second width that is different than the first width and that is adapted to slidably receive a second door guide member therein, wherein the first portion is at least partially vertically offset and at least partially offset along a length of the first portion from the second portion; and a second track positionable across the select one of a bottom wall and a top wall of a storage assembly, the second track including a first portion having a first width adapted to slidably receive a third door guide member therein, and a second portion having a second width that is different than the first width of the second track and that is adapted to slidably receive a fourth door guide member therein, wherein the first portion of the second track is at least partially vertically offset and at least partially offset along a length of the first portion from the second portion of the second track.

10. The door track assembly of claim 9, wherein at least part of the first portion of the first track that is offset along the length thereof from the second portion of the first track is arcuately-shaped.

11. The door track assembly of claim 9, wherein the first track and the second track are formed within a first track assembly, and wherein the first track assembly is divided into a plurality of separate segments along the length thereof.

12. A storage assembly, comprising:

a storage unit including a top wall, a bottom wall and a pair of sidewalls that cooperate to form an interior space and an opening in communication with the interior space;

a first track disposed across the bottom wall of the storage unit and having a least one longitudinally extending channel;

a second track disposed across the bottom wall of the storage unit and have at least one longitudinally extending channel;

a first door slidably supported within the first and second tracks by at least one first guide member;

a second door slidably supported within the first and second tracks by at least one second guide member; and a lock assembly including a lock member having a plurality of reliefs and movable between an unlocked position, wherein the plurality of reliefs are aligned with the channels of the first and second tracks, thereby allowing the at least one first guide member and the at least one second guide member to pass by the lock member and move along the length of the first and second tracks, and a locked position, wherein the plurality of reliefs are not aligned with the channels of the first and second tracks, thereby preventing the at least one first guide member and the at least one second guide member to pass by the lock member and move along the length of the first and second tracks.

13. The storage assembly of claim 12, further including:

a track assembly that includes the first track and the second track, and wherein the lock member is slidably disposed within the track assembly.

14. The storage assembly of claim 12, wherein the lock assembly further includes a lock strike assembly operably coupled to the lock member, wherein the lock strike assembly includes a two-bar linkage including a first linkage having a first end pivotably coupled to the first door, a second linkage having a first end pivotably coupled to a second end of the first linkage and a second end pivotably and slidably coupled to the first door, and wherein the second end of the second linkage actuates the lock member from the unlocked position to the lock position.

15. The storage assembly of claim 12, wherein the lock member is biased towards an unlocked position.

16. The storage assembly of claim 15, wherein the lock member is biased towards an unlocked position by a coil spring.

* * * * *